US005493271A

United States Patent [19]

Kobayashi et al.

[11] Patent Number: 5,493,271

[45] Date of Patent: Feb. 20, 1996

[54] FIRE ALARM SYSTEM

[75] Inventors: Takashi Kobayashi; Akio Tsumuji, both of Tokyo, Japan

[73] Assignee: Nohmi Bosai Ltd., Tokyo, Japan

[21] Appl. No.: 129,083

[22] PCT Filed: Feb. 2, 1993

[86] PCT No.: PCT/JP93/00124

§ 371 Date: Oct. 4, 1993

§ 102(e) Date: Oct. 4, 1993

[87] PCT Pub. No.: WO92/14196

PCT Pub. Date: Aug. 20, 1992

[30] Foreign Application Priority Data

Feb. 4, 1992 [JP] Japan ..... 4-019176
Mar. 31, 1992 [JP] Japan ..... 4-076963

[51] Int. Cl.[6] ..... G08B 26/00

[52] U.S. Cl. ..... 340/505; 340/518; 340/588; 340/825.06

[58] Field of Search ..... 340/505, 514, 340/518, 588, 589, 825.06, 825.07, 825.08, 825.09, 825.1, 825.52, 825.54

[56] References Cited

U.S. PATENT DOCUMENTS 4,525,700 6/1985 Kimura et al. ..... 340/505
4,673,920 6/1987 Ferguson et al. ..... 340/505
4,796,025 1/1989 Farley et al. ..... 340/825.08
4,901,316 2/1990 Igarashi et al. ..... 340/825.08
4,942,552 7/1990 Merrill et al. .
4,996,518 2/1991 Takahashi et al. ..... 340/518
5,194,846 3/1993 Lee et al. ..... 340/505
5,227,763 7/1993 Kikuchi ..... 340/505

FOREIGN PATENT DOCUMENTS 0279864 8/1988 European Pat. Off. .

*Primary Examiner*—Edward L. Coles, Sr.
*Assistant Examiner*—Thomas D. Lee
*Attorney, Agent, or Firm*—Wenderoth, Lind & Ponack

[57] ABSTRACT

A fire alarm system has address numbers that are given to terminal devices, such as transmitters, analog fire detectors and addressable fire detectors, and are given to the fire receiver similarly to the foregoing terminal devices. A signal to be transmitted from the fire receiver is given the address of the fire receiver as the sender address as well as the addresses of the terminal devices which are the information receivers, and a signal to be transmitted from the terminal device is given the address of the receiver of the signal as well as the self-address. As a result, information can be directly transmitted to the terminal devices, and therefore, the load of the fire receiver can be reduced. When the fire receiver and the terminal device transmit the data signal, a data length signal denoting the length of the data to be transmitted is calculated, and the data length signal is transmitted together with the data signal. As a result, the portion for receiving the signal group is enabled to discriminate and receive the data signal, the length of which has been instructed by the data length signal.

2 Claims, 12 Drawing Sheets

FIG. 3

STORAGE REGION FOR
LINKAGE TABLE FOR
SECOND MAIN TRANSMITTER (ROM13)

| MAIN TRANSMITTER NO. | DEVICES TO BE CONTROLLED | | | | | |
|---|---|---|---|---|---|---|
| | LOCAL BELL | EMERGENCY DOOR | FIRE DOOR | SMOKE BARRIER | SMOKE VENTING PORT | ..... |
| 1 | 1 | 0 | 1 | 0 | 1 | ..... |
| 2 | 1 | 0 | 1 | 0 | 1 | ..... |
| 3 | 0 | 1 | 1 | 0 | 0 | ..... |
| 4 | 0 | 0 | 0 | 0 | 0 | ..... |
| ..... | | | | | | |

FIRE ALARM SYSTEM

BACKGROUND OF THE INVENTION

1. Technical Field

The present invention relates to a fire alarm system having a fire receiver, terminal devices such as transmitters and fire detectors connected to the fire receiver, and devices to be controlled such as fire doors and local alarm sounding devices, and more particularly to the transmission of a fire signal, a control signal and the like between the terminal devices and between the fire receiver and the terminal devices.

2. Background Art

Recently, a polling-type fire alarm system has been employed in a building having a relatively large size. In a fire alarm system of the foregoing type, fire information (whether or not a fire signal is present and a physical quantity signal of a fire phenomenon) and control information (an operating command and a restoring command to the device to be controlled, and state signal of the device) are transmitted and received between a fire receiver and terminal devices disposed at various portions in the building, namely, supervisory terminals such as fire detectors and gas leakage detectors, transmitters to which devices to be controlled such as fire doors, smoke dampers and smoke barrier are connected, and analog fire detectors and the like. The fire receiver has an internal ROM (Read Only Memory) which previously stores the addresses of the terminal devices, contents to be displayed at the time of a fire, and linkage information about the devices to be controlled and the like. In accordance with the stored information, the transmitters and the analog fire detectors and the like are polled to collect fire information and information about the devices to be controlled. If information indicating the occurrence of fire has been determined from the fire information, the discriminated contents are displayed and the relative devices to be controlled are linkage-controlled.

Since the conventional polling-type fire alarm system has been constituted while using the fire receiver as the main device as described above, information cannot directly mutually be transmitted and received between the terminal devices such as the transmitters and the analog fire detectors. If information is transmitted and received between two transmitters for example, the fire receiver must be interposed. The reason for this is that the timing for the terminal device to transmit the signal is determined by the fire receiver without exception.

Therefore, the load for the fire receiver to bear is too heavy, and accordingly, a problem arises in that a failure of the fire receiver deteriorates the overall function of the system.

Further, in the conventional polling-type fire alarm system, the signal transmission between the fire receiver and the terminal devices has been performed while employing a predetermined signal length, that is, a fixed length. If a signal having a length except for the predetermined length is received, a discrimination is made that a transmission error has occurred. The reason for this is that the signal transmission rate between the fire receiver and the terminal devices must be raised to detect a fire and to give an alarm as soon as possible.

In a case of a plant consisting of a multiplicity of buildings or a large-scale building such as a skyscraper, a very large number of supervisory devices, such as fire detectors, and devices to be controlled are connected to the fire receiver through transmitters, or a multiplicity of analog detectors are connected to the fire receiver. If the building is enlarged or the layout is changed, the numbers of the supervisory terminals, the devices to be controlled, the transmitters and the analog fire detectors are increased or the contents to be displayed on the fire receiver are changed.

In the conventional arrangement in which a ROM in the fire receiver previously stores various information items (the addresses of the terminals, data about the contents to be displayed and data about linkage-control and the like) about the terminal devices, the enlargement of the building or the layout change of the building or the occupancy change of the same necessitates the ROM to be changed to another ROM on which novel data is written. At this time, a complicated operation of correctly writing various data items must be performed.

Therefore, it has been considered feasible to employ a fire alarm system in which: a representative transmitter is provided for each building or plural stories and a ROM is provided for each of the representative transmitters, or a ROM is provided for each transmitter, and various data about the portion covered by the transmitter is stored in the ROM of the transmitter, the fire receiver collects the various data stored in the ROM of each transmitter, and fire supervisory and control are performed in accordance with the collected data. As a result of the foregoing structure, the enlargement of the building necessitates only writing of various data about the subject portion on the ROM of a transmitter which is newly disposed. If the layout or the occupancy is changed, only various data in the ROM of the transmitter covering the subject portion must be changed. Therefore, an advantage can be realized in that the contents of the ROM of the transmitters except for the changed portions do not need to be changed.

However, a fire alarm system of the foregoing type must transmit information data stored in the ROM of each transmitter in addition to the-necessity of transmitting the fire information and the control information. If the foregoing various information items are transmitted with a fixed-length-signal as performed in the conventional system, the fact that the information data to be stored in the ROM is longer than the fire information and the control information raises a necessity of performing the data transmission operation while dividing the operation into plural times. Therefore, a problem arises in that a long time takes to complete the transmission. In particular, if information data is collected from all transmitters to periodically check whether or not information data collected by the fire receiver has an error, a problem arises in that it takes an excessively long time to transmit the data and in the meantime, the fire supervisory function cannot be performed.

SUMMARY OF THE INVENTION

The present invention is directed to overcome the foregoing problems, and therefore, an object of the invention is to provide a fire alarm system enabled to transmit and receive information directly between terminal devices as well as among a fire receiver and terminal devices such as transmitters or analog fire detectors to reduce the load of the fire receiver to transmit data.

Another object of the present invention is to provide a fire alarm system in which the length of a transmission signal can be varied in accordance with the quantity of information to be transmitted.

A fire alarm system according to a first aspect of the present invention is a fire alarm system having a fire receiver to which a plurality of terminal devices are connected and arranged so that the fire receiver polls each of the terminal devices to transmit and receive a data signal, the fire alarm system being characterized in that: each of the fire receiver and the plural terminal devices comprises: a self-address memory for storing a self-address added for the purpose of mutual identification; a receiver address memory for storing the addresses of other terminal devices and the fire receiver, which are the receivers of the signal; a signal transmitter for transmitting the data signal in such a manner that the self-address stored in the self-address memory and the addresses of the receiver stored in the receiver address memory are added to the data signal; and a comparator for comparing an address signal of the receiver included in the signal received and the self-address stored in the self-address memory and for performing a discrimination process for processing the received data signal if the two addresses coincide with each other.

A fire alarm system according to a second aspect of the invention is a fire alarm system having a fire receiver to which a plurality of terminal devices are connected and arranged so that the fire receiver polls each of the terminal devices to transmit and receive a data signal, the fire alarm system being characterized in that: each of the fire receiver and the plural terminal devices comprises; a data length calculator for calculating the length of the data signal to be transmitted to form a data length signal; a signal group transmitter for transmitting a signal group including the data signal and the data length signal formed by the data length calculator; and a decoder means for decoding the content of each signal of the signal group when the signal group is received and determining the length of the data signal from the data length signal included in the signal group.

A fire alarm system according to a third aspect of the invention is a fire alarm system having a fire receiver to which a plurality of terminal devices are connected and arranged so that the fire receiver polls each of the terminal devices to transmit and receive a data signal, the fire alarm system being characterized in that: each of the fire receiver and the plural terminal devices comprises; a self-address memory for storing a self-address added for the purpose of mutual identification; a receiver address memory for storing the addresses of other terminal devices and the fire receiver, which are the receivers of the signal; a data length calculator for calculating the length of the data signal to be transmitted to form a data length signal; a signal group transmitter for transmitting a signal group formed by adding the self-address stored in the self-address memory, the addresses of the receivers stored in the receiver address memory and the data length signal formed by the data length calculator to the data signal; and a decoder means for comparing an address signal of the receiver included in a received signal and the self-address stored in the self-address memory, decoding the content of each signal in the received signal group if the receiver address signal and the self-address coincide with each other, and determining the length of the data signal in accordance with the data length signal included in the signal group.

A fire alarm system according to the first aspect of the invention has an arrangement that address numbers, that are given to terminal devices, such as transmitters, analog fire detectors and addressable fire detectors, and are given to the fire receiver similarly to the foregoing terminal devices, a signal to be transmitted from the fire receiver is given the address of the fire receiver as the sender address as well as the addresses of the terminal devices which are the information receivers, and a signal to be transmitted from the terminal device is given the address of the receiver of the signal as Well as the self-address. Therefore, the fire information and the control information can be transmitted and received among the terminal devices as well as the transmission and reception of the fire information and the control information between the fire receiver and the terminal devices. As a result, even if a disconnection has taken place in a signal line arranged between the fire receiver and the terminal device or if the fire receiver has broken down, the fire information and the control information can be transmitted and received between the terminal devices. Therefore, the linkage operation among the terminal devices can be performed.

While the system is in a completely normal state, the fire information and/or linkage control information can also be transmitted directly to the concerned terminal devices as well as transmitting the fire information from the terminal device, which has detected fire, to the fire receiver. As a result, the load for the fire receiver to bear at the time of fire can be reduced.

In the second aspect of the present invention, the data length signal indicating the length of a data signal to be transmitted is calculated at the time of transmitting the data signal, and the data length signal is also transmitted. When the signal group thus transmitted is received, the decoder is able to discriminate and receive the data signal, the length of which has been instructed with the data length signal. As a result, the quantity of information to be transmitted can be made arbitrary, the transmission time can be varied in accordance with the length of the data signal, and therefore, waste in transmission can be prevented.

In the third aspect of the invention, when the data signal is transmitted, the data length signal indicating the length of the data signal to be transmitted is calculated, and the data length signal, the address of the sender and the address of the receiver are transmitted collectively. Therefore, the fire information and the control information can be transmitted and received among the terminal devices. Further, waste in data transmission can be prevented.

BRIEF DESCRIPTION OF DRAWINGS

FIG. 3 is a view which illustrates a storage format of a linkage table storage region ROM 13 employed in the first embodiment;

DESCRIPTION OF THE PREFERRED EMBODIMENTS

Figure 2:
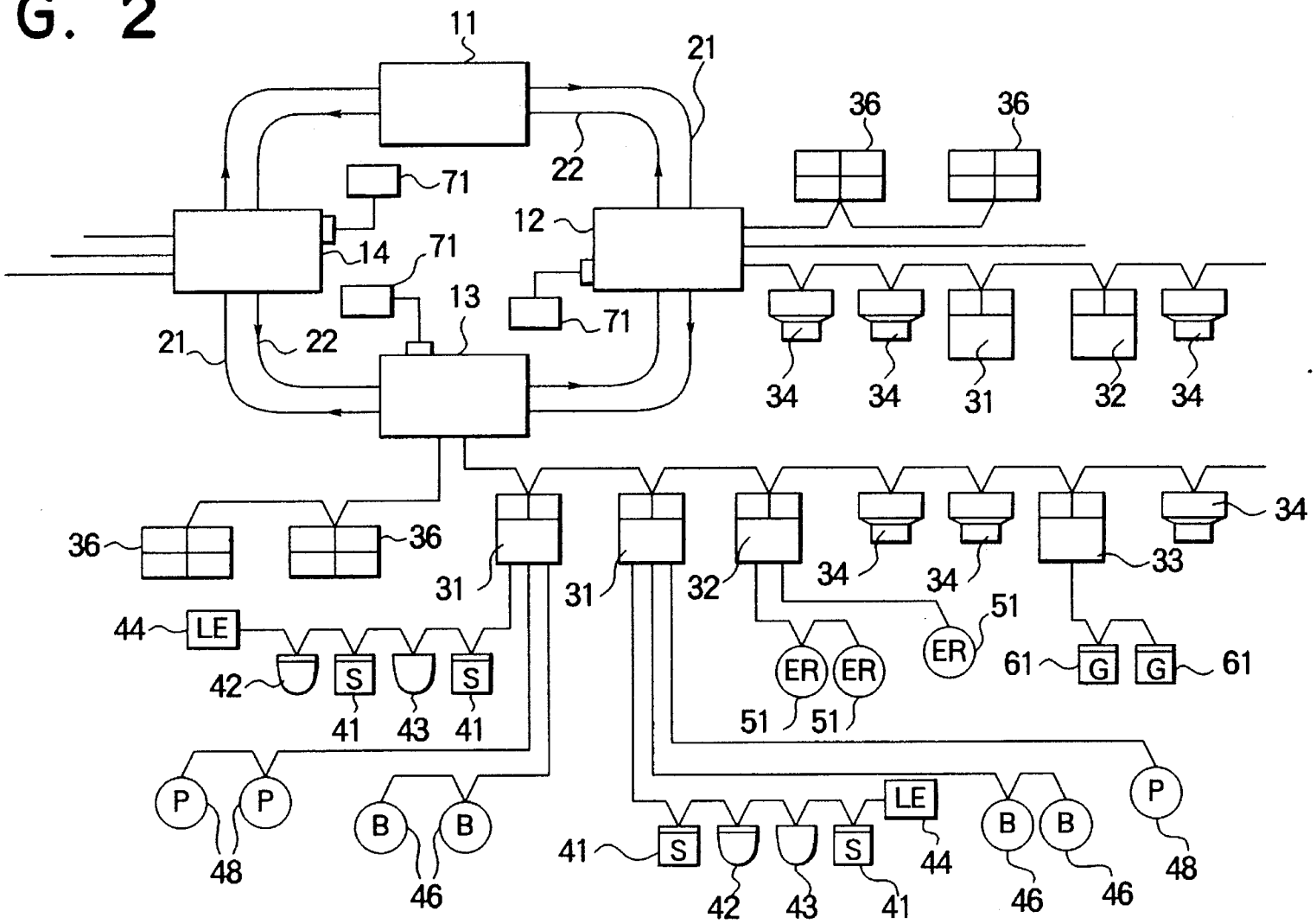
FIG. 2 is a system view which illustrates a fire alarm system according to the first embodiment of the present invention.

FIG. 2 is a view which illustrates the structure of a fire alarm system according to a first embodiment of the present invention. Main transmitters, that is, sub-receivers 12 to 14, are connected to a central receiver 11. The central receiver 11 and the main transmitters 12 to 14 are connected to each other in the form of a loop by two systems of signal lines including a main loop signal line 21 for transmitting a signal in one direction and a sub-loop signal line 22 for transmitting the signal in another direction. A variety of sensors are connected to each of the main transmitters 12 to 14, and devices to be controlled are connected thereto while interposing normal transmitters. In the structure shown in FIG. 2, supervisory transmitters 31, control transmitters 32, gas-leakage transmitters 33, photoelectrical type or ionization type or thermal type analog fire detectors 34, displays 36, ordinary smoke detectors 41, rate-of-rise detectors 42, fixed-temperature detectors 43, end-of-line devices 44, local alarm sounding devices 46 comprising bells, manual fire alarm call points 48, devices to be controlled 51, such as the closing devices of fire doors and the releasing devices of smoke dampers, and gas leakage detectors 61 and the like are connected. Furthermore, display/control devices 71 can be detachably connected to each of the main transmitters 12 to 14. By connecting the display/control devices 71 to the main transmitters 12 to 14, instructions and the like transmitted from the central receiver 11 can be transmitted from the display and control device 71 through the main transmitters 12 to 14 and data to be displayed on the central receiver 11 can be transmitted on the display and control devices 71 through the main transmitters 12 to 14.

The display/control device 71 has a display portion and a control portion. The display portion has various displays and display lamps such as a fire region display, a smoke block/exhaust display, a gas-leakage-region display, a fire lamp, an accumulation-indication lamp, a local alarm sounding stoppage lamp, a test continuation lamp switch alarm lamp, an AC power source lamp, and a main transmitter interruption indication lamp that is lit on when the main transmitter is in an interrupted state from the fire receiver 11 or the like. On the other hand, the control portion has a power switch, a main-transmitter interrupting switch, a sound stoppage switch, a local alarm sounding stoppage switch, an accumulation cancellation switch, various test switches, a linkage and information shift interruption switch, a restoring switch and a ten-key for inputting the numbers of controlled smoke block and exhaust devices and those of the terminal devices to be tested.

The central receiver 11 and the main transmitters 12 to 14 respectively are equally given addresses with continuous numbers. Further, a polling signal, a return signal and the like are transmitted between the central receiver 11 and each of the main transmitters 12 to 14 and among the main transmitters 12 to 14 through the main loop signal line 21. Simultaneously, the same signals as those to be transmitted through the main loop signal line 21 are transmitted through the sub-loop signal line 22 in the opposite direction. Therefore, the central receiver 11 and the respective main transmitters 12 to 14 are able to receive the same signals through both of the main loop signal line 21 and the sub-loop signal line 22. If a signal has been received from the main loop signal line 21, then only the receipt signal from the main loop signal line 21 is received by an unillustrated internal signal processing circuit having, for example, a microcomputer to process the signal. If the signal receipt from the main loop signal line 21 is cancelled due to an abnormality such as a disconnection, then the signal received through the sub-loop signal line 22 is received by the internal signal processing circuit.

As a result of the foregoing structure, the main transmitters 12 to 14 usually receive signals supplied from the various sensors in response to the polling signal transmitted from the central receiver 11 through the main loop signal line 21 to perform signal process for supervising fire and return the result to the central receiver 11. If the occurrence of fire is detected, the main transmitters 12 to 14 control the operation of the devices to be controlled, such as fire doors and the like, in accordance with an instruction issued from the central receiver 11. The central receiver 11 and the main transmitters 12 to 14 are given the addresses to be operated equally so that the main transmitters 12 to 14 are able to directly transmit/receive signals if necessary without interposing the central receiver 11.

FIG. 2 illustrates an internal circuit of each of the main transmitters 12 to 14. Referring to FIG. 2, MPU 2 is a microprocessor; ROM 11 is a program storage region which stores a program to be described later which is arranged to operate the microcomputer, and ROM 12 is a self-address storage region. In order to set and store the self-address, switches such as dip switches may be employed.

A ROM 13 is a linkage control table storage region for terminal devices to be controlled, such as local bells and fire doors connected to the main transmitter. As shown in FIG. 3, stored in the ROM 13 are the devices to be linkage-controlled in accordance with fire supervisory information supplied from the supervisory terminal device connected to the main transmitter and the devices to be linkage-controlled connected to the main transmitter when another main transmitter detects fire.

A ROM 14 is a region for storing the addresses of the information receivers. Stored in the ROM 14 are the address of another main transmitter to which the fire signal must be transmitted beside the central receiver 11 when a fire state is detected by the supervisory terminal device connected to the main transmitter, and the address of the information receiver and the like if the main transmitter has contents to be transmitted to another main transmitter. The address of the information receiver may be set by a dip switch or the like. Another operation different from that illustrated in a flowchart to be described later may be employed in which the devices to be linkage-controlled and the contents to be controlled by the transmitter or the like of the information receiver are collectively stored in addition to the address of the transmitter of the information receiver.

A RAM 11 is a storage region for storing an operational region, and a RAM 12 is a storage region for storing state information about various terminal devices (whether or not fire occurs and present states of the devices to be controlled and the like) connected to the main transmitter. RAM 13 is a storage region for storing the address of the signal sender of the received signal. If a signal has been received from the fire receiver or another main transmitter, the address of the signal sender is stored. The address of the signal sender is made to be the address of a receiver of the returned state signal and the response signal.

A RAM 14 is a storage region for storing the contents to be transmitted in such a manner that the contents of information formed by the transmission and reception of a signal by polling between the main transmitter and the central receiver 11 are not stored but other information formed by the transmission and reception of a signal transferred among, for example, the main transmitters is stored if necessary. In this case, as the contents to be informed, there are stored the address of the specific information receiver (for example, the address of the main transmitter required at the time of performing the linkage-control) stored in the storage region ROM 14, the self-address stored in the storage region ROM 12 and transmission information (for example, the fire signal) stored in the storage region ROM 13.

A TRX 11 is a transmitting and receiving portion comprising a parallel to serial converter or a serial to parallel converter for enabling the main transmitter to transmit a signal to the central receiver 11 or another main transmitter, and further comprising a loop-back circuit or the like for forming a loop-back path for establishing the connection between the main loop signal line 21 and the sub-loop signal line 22 when the main loop signal line 21 or the sub-loop signal line 22 is disconnected. A TRX 12 is a transmitting and receiving portion having a parallel to serial converter or a series/parallel converter for enabling the main transmitter to transmit a signal to a sub-transmitter connected to the main transmitter, that is, to a lower transmitter or the analog fire detector.

Figure 4:
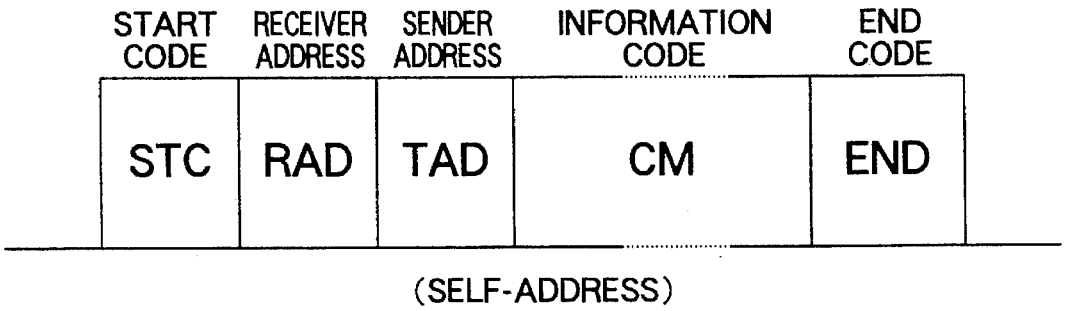
FIG. 4 is a view which illustrates the format of a transmission signal employed in the first embodiment.

FIG. 4 illustrates the format of the signal to be transmitted. Referring to FIG. 4, STC denotes a start code, RAD denotes the address of the information receiver, TAD denotes the address of the signal sender (the self-address), CM denotes an information code, and END denotes an end code.

The operation of the first embodiment will now be described with reference to the flowchart shown in FIGS. 5 and 6. The central receiver 11 polls the respective main transmitters 12 to 14 so that the respective main transmitters 12 to 14 return state information of the environment (the sensor level of the smoke density or the temperature) supplied from the environment supervisory terminal devices such as the fire detectors connected to the main transmitter usually in response to a polling signal supplied from the central receiver 11. The central receiver 11, which has received the environment state information, determines whether or not a fire has occurred in accordance with the state information.

Each of the main transmitters always supervises the signal receipt by the main transmitters in step 102. The signal receipt is categorized into a case where a signal from the central receiver 11 is received and a case where a signal from another main transmitter is received. If no signal receipt to the receiver is effected, the main transmitters read state information supplied from the terminal devices connected to the main transmitters to update the contents in the storage region RAM 12 in step 106. Further, a determination as to whether or not a fire has occurred and a determination as to whether or not the notification to another transmitter is required are made in accordance with information stored in the storage region RAM 12 in steps 108 and 110.

When the supervisory terminal device connected to the main transmitter has detected the fire state, the storage region ROM 14 stores the address of another main transmitter to which the state of the fire is required to be directly notified without interposing the central receiver, and the address of the information receiver if the main transmitter has contents to be notified or informed to the other main transmitter. If a determination has been made in step 108 in accordance with the information stored in the storage region RAM 12 that a fire has occurred, the address of the fire signal receiver is read out from the storage region ROM 14 in step 112. The foregoing address of the signal receiver is made to be the RAD, the self-address is read out from the storage region ROM 12 to make it to be the signal sender address TAD, and the fire signal is made to be the information code CM so that the format of the signal to be transmitted is made and the format is stored in the storage region RAM 14 in step 114.

The linkage table storage region ROM 13, as shown in FIG. 3, stores the devices among the devices to be controlled connected to the main transmitter that must be linkage-controlled if a fire signal is received from the supervisory terminal device connected to the main transmitter or another main transmitter, the device being stored in the form of a table. In the upper column of the table, the devices to be controlled connected to the main transmitter are indicated, while the left column indicates the number or the address of the main transmitter that has detected the fire. The linkage table of the storage region ROM 13 shown in FIG. 3 is, as designated by the mark O, adapted to, for example, the second main transmitter. If the second main transmitter has determined in step 108 shown in FIG. 5 that a fire has occurred, the format of the transmission signal is stored in the storage region RAM 14 in step 114, and then, in step 115, the controlled contents for the second main transmitter are read out from the storage region ROM 13 to control the corresponding devices, that is, the devices, such as the local bells, the fire doors and the smoke exhaust ports indicated by a "1" in FIG. 3.

If a determination has been made in step 110 that notification to another transmitter is required in place of the fire occurrence, the flow proceeds to step 116 in which the information receiver address RAD read out from the storage region ROM 14, the self-address TAD read out from the storage region ROM 12 and the notification content CM are used to make similarly the format of the transmission signal, the format being stored in the storage region RAM 14. The notification content CM is made in accordance with, for example, the state information of the terminal device stored in the storage region RAM 12.

The notification content stored in the storage region RAM 14 in steps 114 and 116 are transmitted to the signal line as follows by making use of an unoccupied time after the signal process has been performed when the signal has been received by the second main transmitter.

Figure 6:
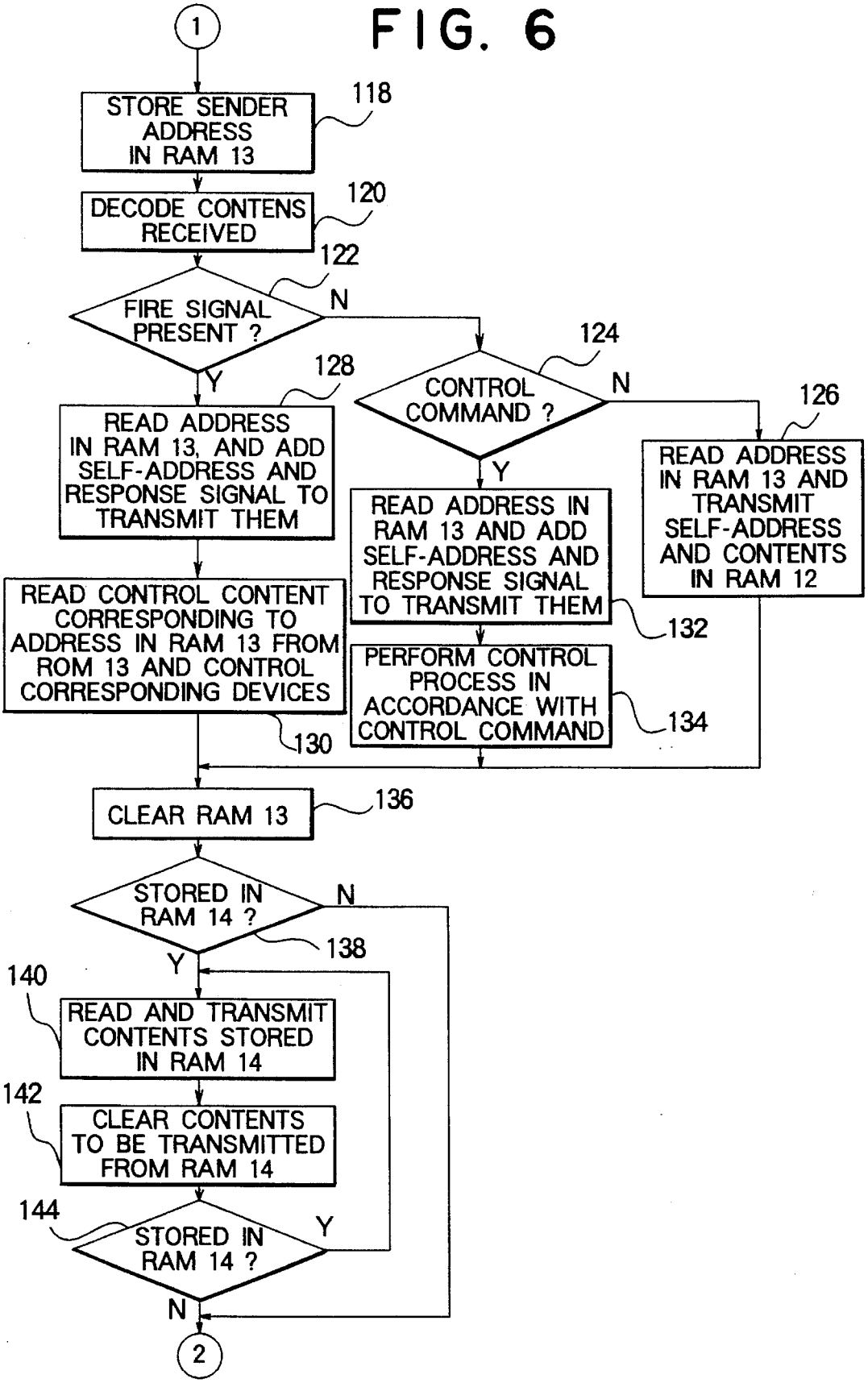

If a determination has been made in steps 102 and 104 that the signal has been received by the second main transmitter, the address of the signal sender which has transmitted the received signal is read out from the TAD of the format in step 118 shown in FIG. 6 to store the address in the storage region RAM 13. Furthermore, its received content CM is decoded in step 120. In accordance with the result of decoding of the received content CM, whether or not the fire signal is present and whether or not a control command is present are determined in steps 122 and 124. If neither the fire signal nor the control command is present, a determination is made that a state information return command has been issued from the central receiver 11. In step 126, the address of the sender stored in the storage region RAM 13, that is, the address of the central receiver 11 is made to be the receiver address RAD, the self-address is made to be the sender address TAD, and the sate information of the terminal device updated and stored in the storage region RAM 12 is made to be the information code CM so that the transmission signal in the format shown in FIG. 4 is made, the transmission signal being transmitted to the transmission path. In step 136, the contents of the storage region RAM 13 are cleared.

When the transmission signal thus-transmitted is received by the central receiver the address of which is stored in the storage region RAM 13, the central receiver is able to know the address is the one to the own central receiver from the RAD portion, and therefore, it receives the sender address TAD and the information code CM.

If a determination has been made in step 122 that a fire-signal is present as a result of decoding of the received content CM performed by the second main transmitter in step 120, it means that the notified contents to the main transmitter stored in the storage region RAM 14 in step 114 have been transmitted. Accordingly, in step 128, the sender address stored in the storage region RAM 13 is made to be the receiver address RAD, the sender address is made to be the TAD, and the response signal is, as the information code CM, added so that the transmission signal, the format of which is shown in FIG. 4 is generated and transmitted to the transmission path. As a result, the response signal is returned to the main transmitter, which is the sender. In step 130, the controlled contents corresponding to the main transmitter at the address of the sender of the storage region 13 are read out from the linkage table of the storage region ROM 13 shown in FIG. 3 to control the corresponding device. Then, the contents of the storage region RAM 13 are cleared in step 136. If the sender is the third main transmitter, the emergency door and the fire door indicated by a "1" among the devices to be controlled connected to the third main transmitter are controlled.

If a determination that the control command is present has been made as a result of decoding of the received content CM performed by the second main transmitter, it means that a command for controlling the devices to be controlled or a control command such as a test command has been issued from the central receiver 11 or that the contents to be informed to another second main transmitter stored in the storage region RAM 14 in step 116 have been transmitted. Accordingly, in step 132, the sender address stored in the storage region RAM 13 is made to be the receiver address RAD, the sender address is made to be the TAD and the response signal is, as the information code CM, added so that the transmission signal the format of which is as shown in FIG. 4 is made to transmit the signal to the transmission path. As a result, a response signal is returned to the sender main transmitter. Then, a control process is performed in step 134 in accordance with the control command transmitted from the central receiver 11 or another main transmitter. Then, the contents of the storage region RAM 13 is cleared in step 136.

After decoding of the received contents and the control operation in accordance with the decoded contents have been performed, the operations in steps 138 to 144 are performed. That is, an operation of transmitting the contents stored in the storage region RAM 14 in steps 114 or 116 is performed. After the transmission has been completed, the contents of the storage region RAM 14 are cleared. Then, the flow returns to an initial signal-receipt waiting state in step 102.

Figure 5:
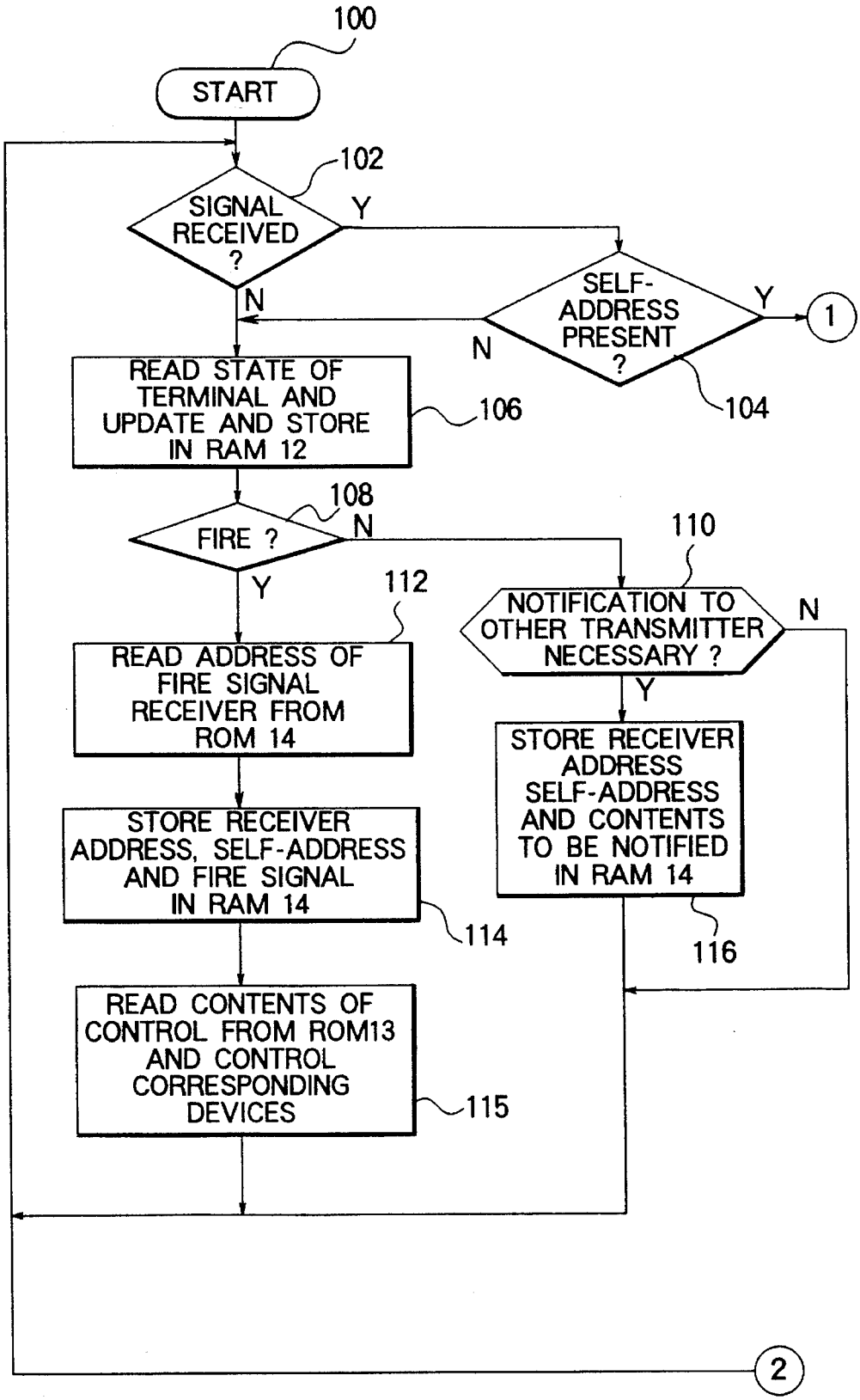
FIGS. 5 and 6 together form a flowchart for explaining the operation of the main transmitter according to the first embodiment.

In FIGS. 5 and 6, the main transmitter is called from the fire receiver or another main transmitter in step 104. When the signal is, in step 126 or 128 or 132, returned to the fire receiver or the main transmitter which has made the call, information (for example, the fire signal) to be notified to the other fire receiver or the main transmitter is also sent to the foregoing fire receiver and the main transmitter in steps 138 to 144 if the information is present. If information to be informed is present, the information may be transmitted at a time no transmission signal flows through the signal line.

Although FIGS. 5 and 6 illustrate the flowchart for transmitting and receiving the signal between the fire receiver and the main the transmitter and among the main transmitters, signal transmission may be performed by a similar method among the main transmitter and the sub-transmitters (the ordinary transmitters such as the transmitters 31, 32 and 33) connected to the main transmitter or the other terminal devices such as the analog fire detectors. Even if the terminal devices, such as the sub-transmitters or the analog fire detectors, are connected to the fire receiver without interposing the main transmitter, the signal transmission can be performed by a similar method between each of the foregoing terminal devices and the central receiver.

The structure shown in FIG. 2 may be arranged in such a manner that an input device such as a ten-key pad is provided for the main transmitter and the ROMs 12 to 14 are made to be, for example, RAMs which have a backup power source and which are reloadable storage devices capable of storing the contents even if the power supply is interrupted due to a power outage or the like so that the self-address, the linkage control data and the address of the receiver of the informed contents and the like are input by using the input device such as the ten-key.

As described above, according to the first embodiment, the address numbers are also given to the fire receiver to which the terminal devices, such as the transmitters, the analog fire detectors and the addressable-fire-detectors are connected in addition to giving address numbers to the foregoing terminal devices. Further, the signal to be transmitted from the fire receiver is given the address of the fire receiver as the address of the sender as well as the address of the receiver terminal devices. In addition, the signal transmitted from the terminal device is given the address signal of the receiver of the signal as well as the own address of the terminal device. Therefore, the direct transmission and reception of the fire information and the control information can be performed among the terminal devices in addition to the transmission and reception of the fire information and the control information between the fire receiver and the terminal device. As a result, even if disconnection takes place in the signal line arranged between the fire receiver and the terminal device, or even if the fire receiver breaks down, the linkage operation among the terminal devices can be performed. Therefore, an effect can be obtained in that the overall function of the facility does not deteriorate.

While the entire system is in a normal state, the terminal device which has detected fire is also able to transmit the fire information to the fire receiver, and the fire information and/or the linkage control information can be directly transmitted to the concerned terminal devices. Therefore, another effect can be obtained in that the load of the fire receiver can be reduced at the time of fire.

Figure 1:
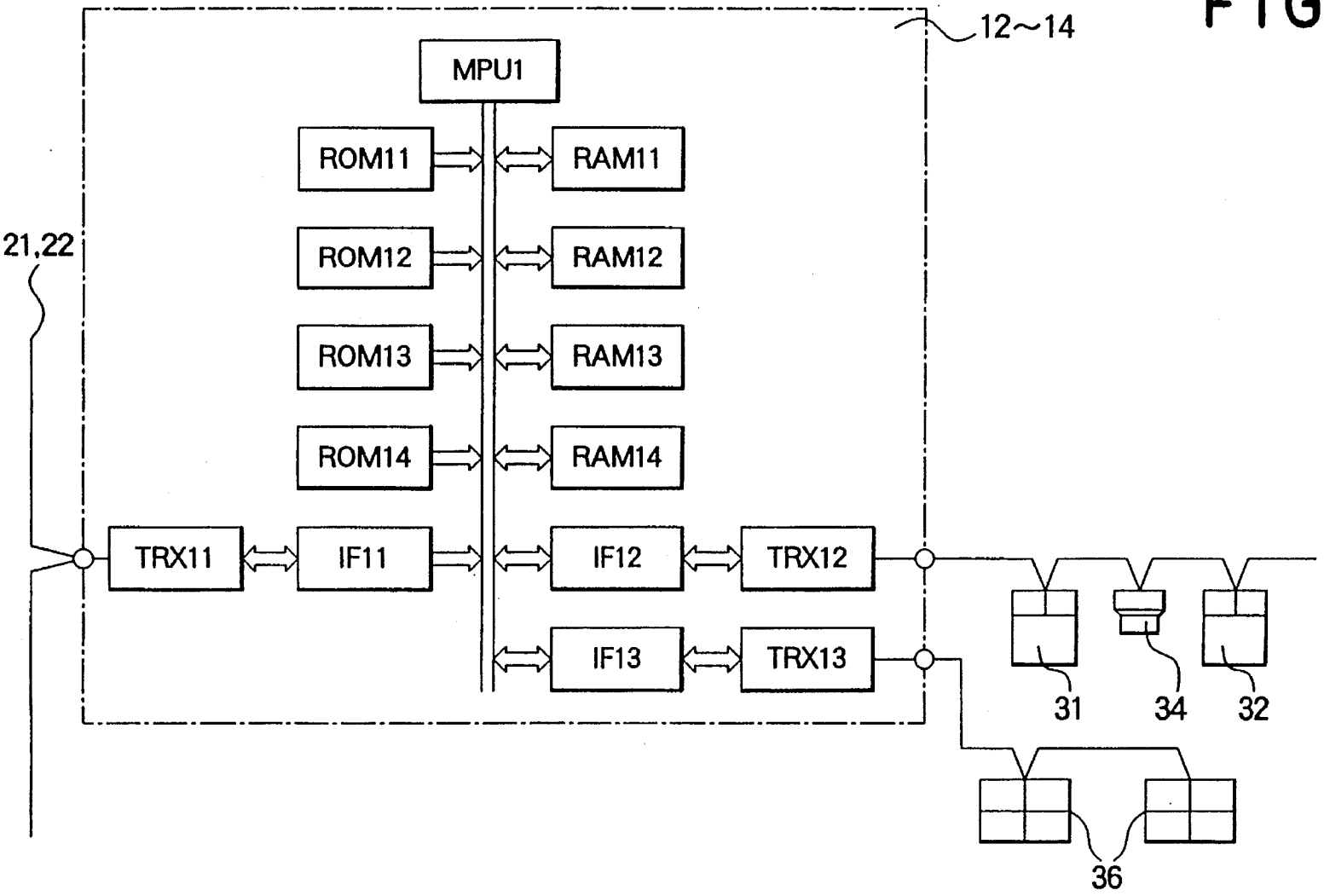
FIG. 1 is a block diagram which illustrates the internal circuit of a main transmitter employed in a first embodiment of the present invention.
Figure 7:
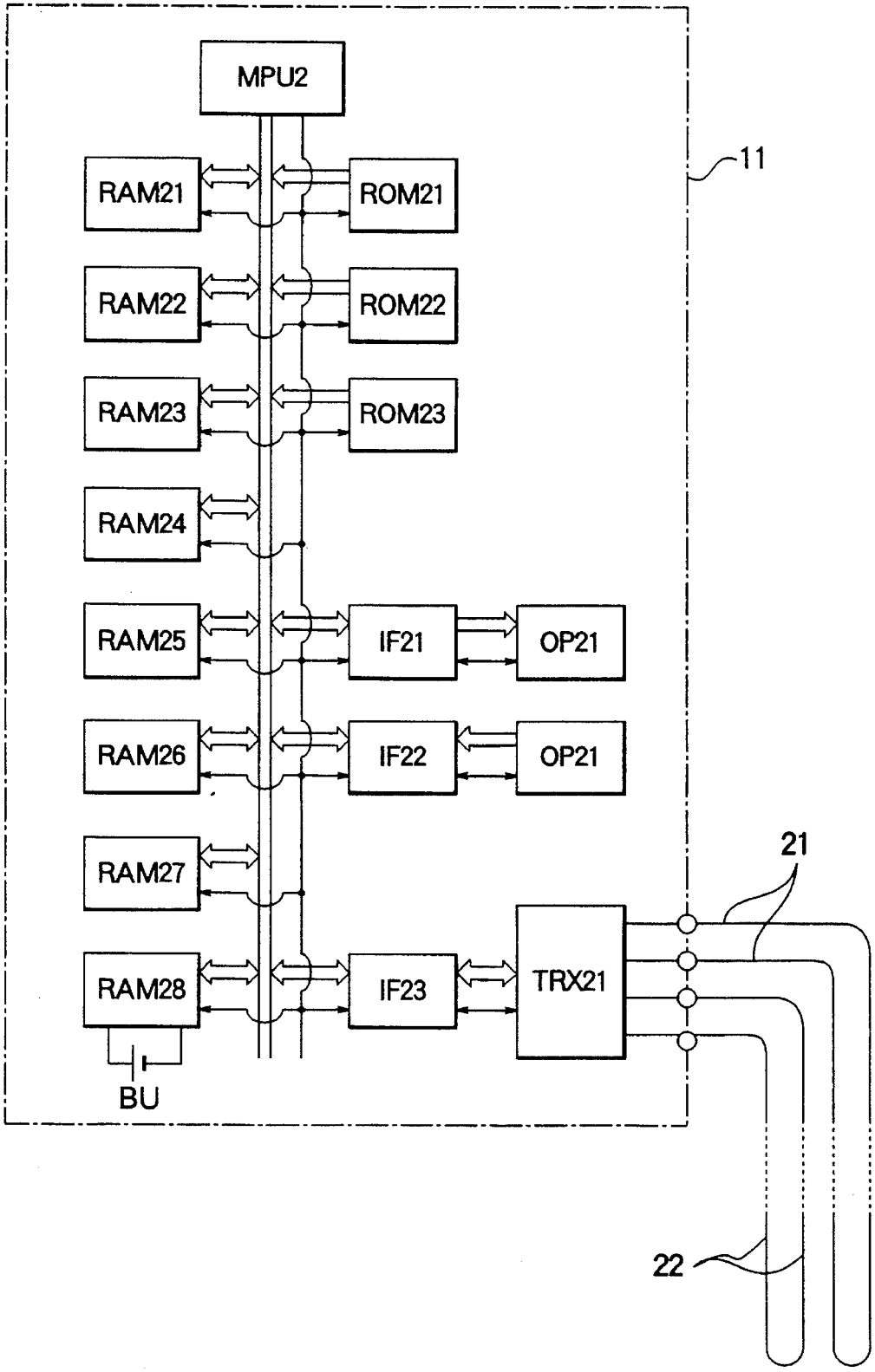
FIG. 7 is a block diagram which illustrates the internal circuit of a fire receiver employed in a second embodiment of the present invention.

A fire alarm system according to a second embodiment of the present invention is described below. The second embodiment has a system structure similar to that of the first embodiment shown in FIG. 1. FIG. 7 illustrates the internal circuit of a fire receiver 11 according to the second embodiment. In the fire receiver 11, MPU 2 is a microprocessor;

ROM 21 is a storage region for storing a program for polling the main transmitters 12 to 14 and a program as shown in the flowchart shown in FIGS. 11 and 12 to be described later. A ROM 22 is a storage region for storing the self-address, and a ROM 23 is a storage region for storing the address of the terminal devices to be connected, that is, the main transmitter 12 to 14 shown in FIG. 1.

A RAM 21 is an operation region. A RAM 22 is a storage region for storing data length DL of transmission data DATA stored in a storage region RAM 24, the RAM 22 being composed of four bits consisting of B11 to B14 in this embodiment. A RAM 23 is a storage region for storing data type identification DI of the transmission data DATA stored in the storage region RAM 24, the RAM 23 being formed by a flag composed of four bits consisting of B21 to B24. The RAM 24 is a storage region for storing the data DATA to be transmitted. A RAM 25 is a storage region for storing state information collected from the main transmitters 12 to 14. A RAM 26 is a storage region for storing the results of tests collected from the main transmitters 12 to 14. A RAM 27 is a storage region for storing control information, that is, control commands, transmitted from the main transmitters 12 to 14. A RAM 28 is a storage region for storing various data bases (DBs) collected from the main transmitters 12 to 14.

Symbol BU represents a backup power source for the storage region RAM 28 for use at the time of power outage, the backup power source BU being made of, for example, a nickel-cadmium battery which is charged by an unillustrated charging circuit. A TRX 21 is a transmitting and receiving portion having a transmitting parallel to serial converter, a receiving serial to parallel converter, a loop-down detecting circuit, and a main-loop/sub-loop turn connection circuit and the like. A DP 21 is a display portion in which a variety of display lamps are provided, for example, a fire region display, a smoke block/exhaust display, a gas leakage region display, displays such as CRTs, a fire lamp, an accumulation lamp, a switch alarm lamp, an AC power source lamp, and main transmitter interruption indication lamp and the like are provided. An OP 21 is a control portion in which are provided a variety of switches, such as a main transmitter interruption switch, a (fire) restoring switch, a fire discrimination switch, a main sound stoppage switch, a local alarm sounding stoppage switch, a test switch, a control switch and a display change-over switch, and a ten-key pad for inputting various data such as the numbers of the main transmitters and those of the terminal devices connected to the main transmitter and the like.

Figure 8:
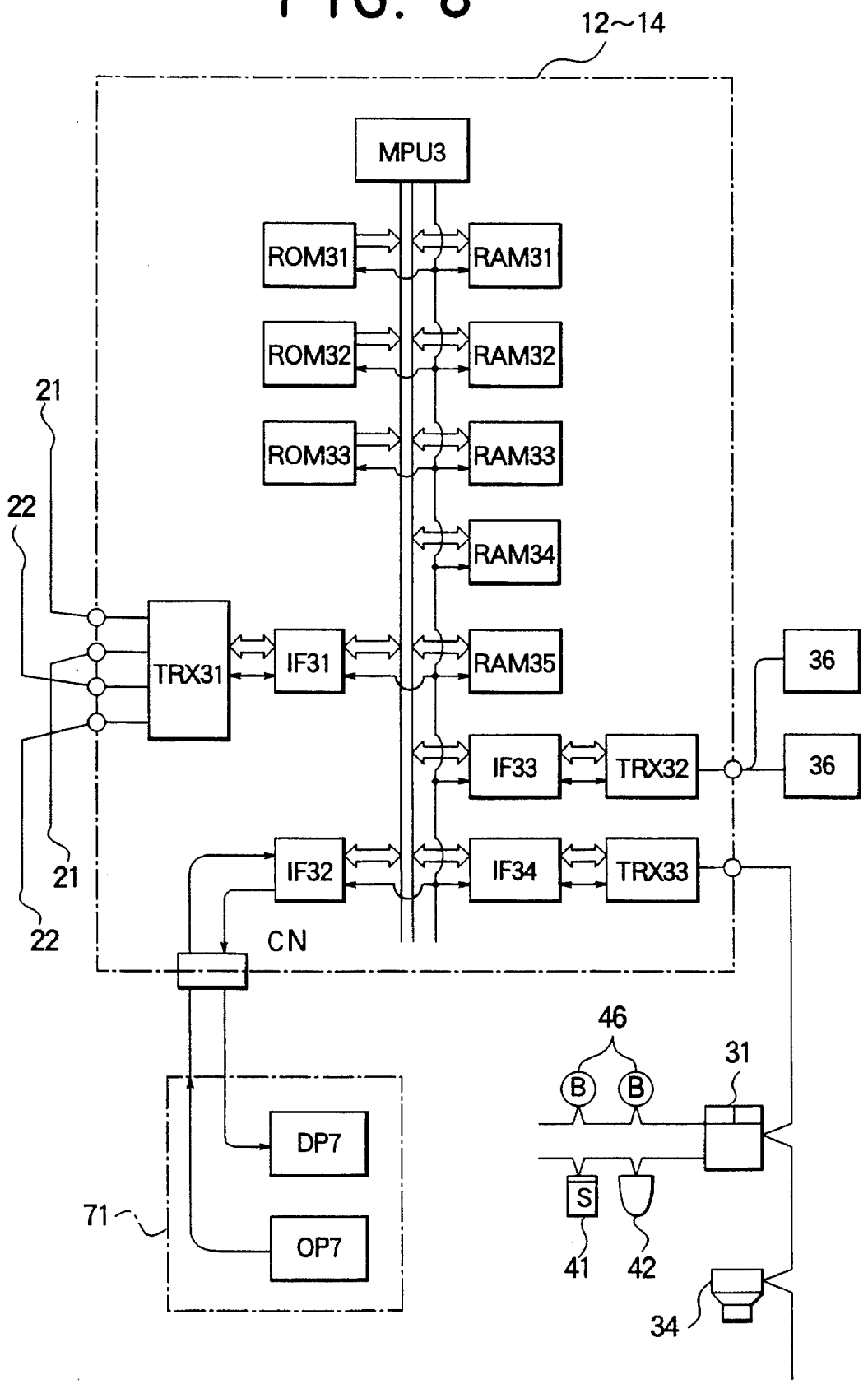
FIG. 8 is a block diagram which illustrates the internal circuit of a main transmitter employed in the second embodiment.

FIG. 8 illustrates the internal circuit of each of the main transmitters 12 to 14 and a display/control device 71 connected to the main transmitter according to the second embodiment. The main transmitters 12 to 14 respectively have a common structure of the internal circuit. Referring to FIG. 8, a MPU 3 is a microprocessor, and a ROM 31 is a storage region for storing a program or the like arranged as shown in the flow chart to be described with reference to FIG. 13. A ROM 32 is a storage region for storing the self-address, the address of the fire receiver 11 and those of the other main transmitters connected while interposing the main loop signal line 21 and the sub-loop signal line 22. A DIP switch may be used in place of the ROM 32.

A ROM 33 is a storage region for storing various data bases, such as, the address and the type of the terminal devices, such as the transmitters (sub-transmitters) and the analog fire detectors connected to the main transmitter, the linkage control table of the devices to be controlled, data (for example, a showroom on the first floor, an office facing the east on the eighth floor, and conference room No. 5 on the fifteenth floor) to be displayed on the display portion DP 21 of the fire receiver 11, and printing data of an unillustrated printer.

A RAM 31 is an operation region. A RAM 32 is a storage region for storing data length DL of transmission data DATA stored in the storage region RAM 34, the RAM 31 being composed of four bits consisting of B11 to B14 in this embodiment. A RAM 33 is a storage region for storing data type identification DI of the transmission data DATA stored in the storage region RAM 34, the RAM 33 being composed of a flag formed by four bits consisting of B21 to B24 in this embodiment. A RAM 34 is a storage region for storing the transmission data DATA. A RAM 35 is a storage region for storing state information (the fire signal, whether or not a gas leakage signal is present, a physical quantity signal of the fire phenomenon, whether or not the local bell is ringing, whether or not the signal line is disconnected and an opening/closing state signal of the devices to be controlled and the like) collected, by polling, from the connected transmitters 31, 32, 33 and the terminal devices, such as the analog fire detectors 34.

A CN is a connector or a connection portion for connecting the display/control device 71. An IF 32 transmits and holds a signal to be displayed on the display portion DP 7 of the display/control device 71. The IF 32 is, for example, an interface having a detection circuit for detecting an input of the operation of a switch or the like from a latch circuit, such as a D type flip-flop, and the operation portion OP 7 of the display/control portion 71.

A TRX 31 is a transmitting and receiving portion structured similarly to the transmitting and receiving portion TRX 21 of the fire receiver 11. A TRX 32 is a transmitting and receiving portion for transmitting the display contents to the display 36 and receiving the local alarm sound stoppage signal from the display 36. A TRX 33 is a transmitting and receiving portion having a parallel to serial converter and a serial to parallel converter for transmitting and receiving signals to and from the terminal devices, such as the transmitters 31, 32, 33 and the analog fire detectors 34.

The format for transmitting data to be transmitted and received between the fire receiver 11 and each of the respective main transmitters 12 to 14 will now be described with reference to FIGS. 9 and 10. Symbol SSY is a start synchronization signal, TAD is a sender address signal, that is, a self-address signal, and RAD is a receiver address signal. Symbol DL is a data length signal for instructing the signal length of the transmission data DATA, data length signal DL being composed of, for example, 4 bits consisting of B11 to B14 as shown in FIG. 10. In this embodiment, the length of the data is indicated in units of 2 bytes such that, when B11 is "1" the length of DATA is 2 bytes, when B12 is "1" the length of DATA is 4 bytes, when B13 is "1" the length of DATA is 8 bytes, when B14 is "1" the length of DATA is 16 bytes, when B11 and B13 are "1" the length of DATA is 10 bytes that is the sum of B11 and B13, and when all of B11 to B14 are "1" the length of DATA is 30 bytes. Incidentally, the number of bits for instructing the length is not limited to this, and the method of instructing the length is not limited to this.

DI is a data type identification signal denoting the contents of data DATA and formed into a 4 bit structure composed of, for example, B21 to B24 as shown in FIG. 10. In this embodiment, B21 is information about state information, B22 is information about test information, B23 is information about control information and B24 is information about DB (data base) information. It should be noted that D1 is not limited to 4 bits and may have any required length. Furthermore, the type of each bit is not limited to this.

Symbol DATA is a data signal including various data, the type of which is instructed by the data type identification signal DI and the length of which is instructed by the data length signal DL, the various data being data about commands (state information request command, test command, test result request command, control command, and DB information request command and the like) issued from the fire receiver 11 to the main transmitters 12 to 14, and data about information (state information, test result information, control information, and DB information and the like) to be returned from the main transmitters 12 to 14 to the fire receiver 11 in response to the various commands issued from the fire receiver 11.

Symbol CRC is an error detection cyclic redundancy check code or CRC code (cyclic redundancy check code). A sum check code may be used as the CRC. ESY is an end synchronization signal.

As for the information included in, for example, the data signal DATA to be returned from the main transmitters 12 to 14 to the fire receiver 11 in response to the command issued from the fire receiver 11, the state information, the test result information, the control information and the DB information and the like are included as described above. Since the state information instructed by B21 of the data type identification signal DI, the test result information instructed by B22 and the control information instructed by B23 respectively have previously determined information quantities, 2 bytes are allocated to each information. As for the DB (data base) information instructed by B24, even-numbered bytes having an arbitrary length corresponding to the volume of the data base to be returned and larger than the foregoing volume are allocated to DB. The respective information items are arranged in the sequential order of B21 to B24 of the data type identification signal DI. In an example case where state information, control information and 8-byte DB information must be transmitted as the DATA signal in the information to be returned from the main transmitters 12 to 14 to the fire receiver 11, the data length is 12 bytes which is the sum of the 2 bytes, the 2 bytes and the 8 bytes. Therefore, B12 and B13 of the data length signal DL are set to "1", and B21, B23 and B24 of the data type identification signal DI are set to "1". Furthermore, the required state information, the control information and the DB information are set to the data signal DATA in the sequential order of B21, B23 and B24 of the data type identification signal DI.

In the portion for receiving the transmitted signal thus-made, the 12 bytes of the data length signal DL in the received signal is decoded, and then "1" of B21, "1" of B23 and "1" of B24 are read from the data type identification signal DI in the received signal. As the result, a fact that the leading 2 bytes in the 12-byte data signal DATA is information about the state information is determined from "1" of B21, and the fact that the ensuing 2 bytes in the data signal DATA is information about the control information is determined from "1" of B23, and the fact that the residual 8 bytes in the data signal is information about the DB information is determined from "1" of B24. As described above, the data signal DATA in the transmitted signal can be transmitted while having a data length instructed by the data length signal DL so that the length can be varied in accordance with the quantity of transmission.

Figure 9:
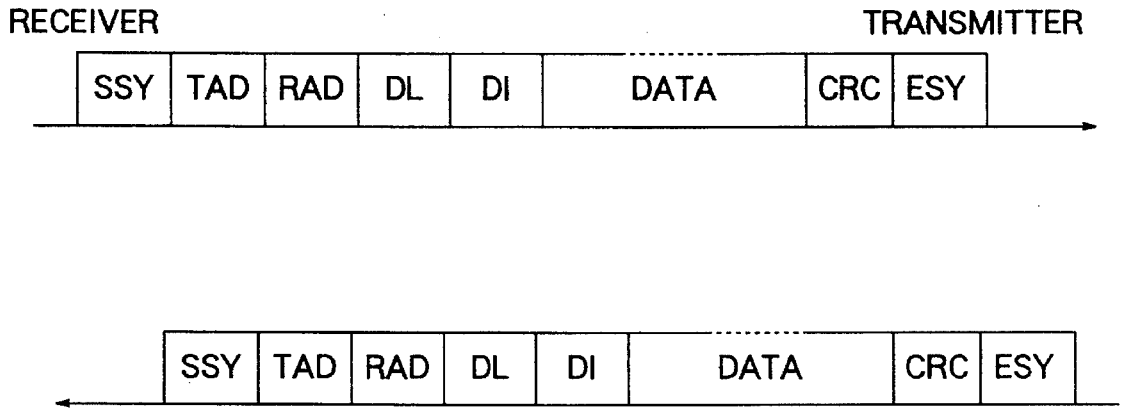
FIGS. 9 and 10 respectively illustrate transmission formats of signals to be transmitted and received between the fire receiver and the main transmitter according to the second embodiment.
Figure 10:
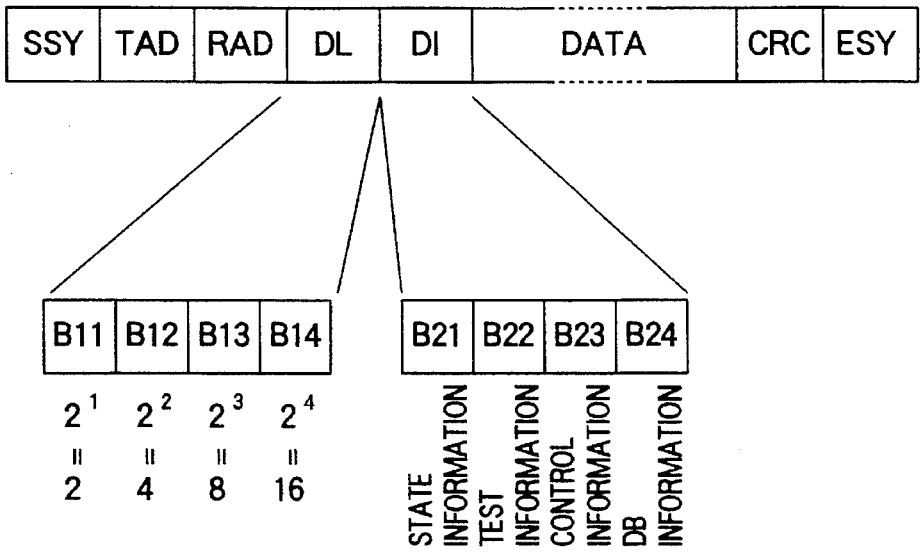

In a case where the signal transmission and reception is performed only between the fire receiver 11 and each of the main transmitters 12 to 14, the signal transmission from the fire receiver 11 to the main transmitters 12 to 14 may be performed while omitting TAD shown in FIG. 9. In another case where the signal is transmitted from each of the main transmitters 12 to 14 to the fire receiver 11, TAD or both of TAD and RAD may be omitted.

The operation of the fire alarm system according to the second embodiment will now be described with reference to the flowchart shown in FIGS. 11 to 13.

Figure 11:
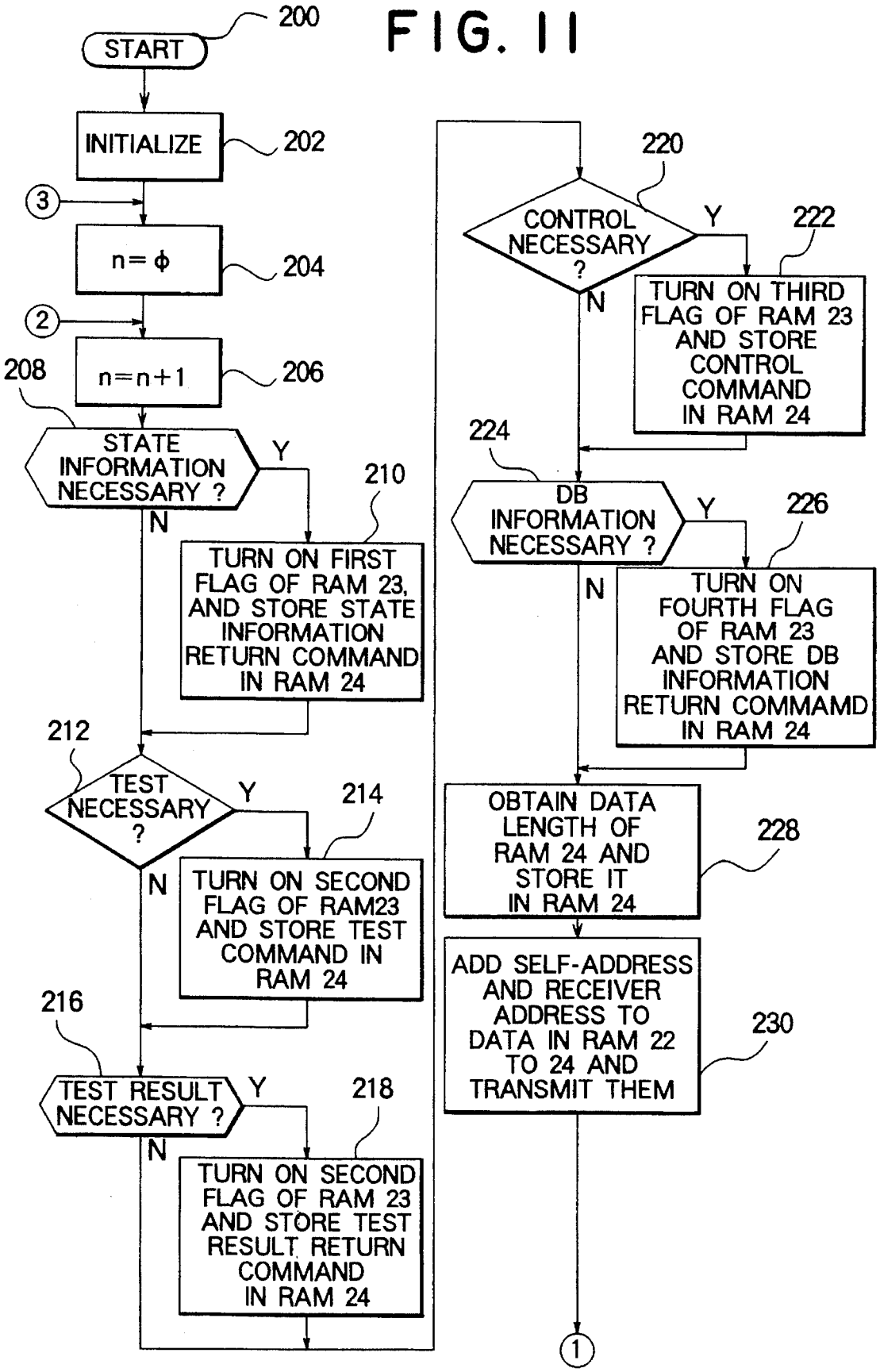
FIGS. 11 and 12 together form a flowchart for explaining the operation of the fire receiver according to the second embodiment.
Figure 12:
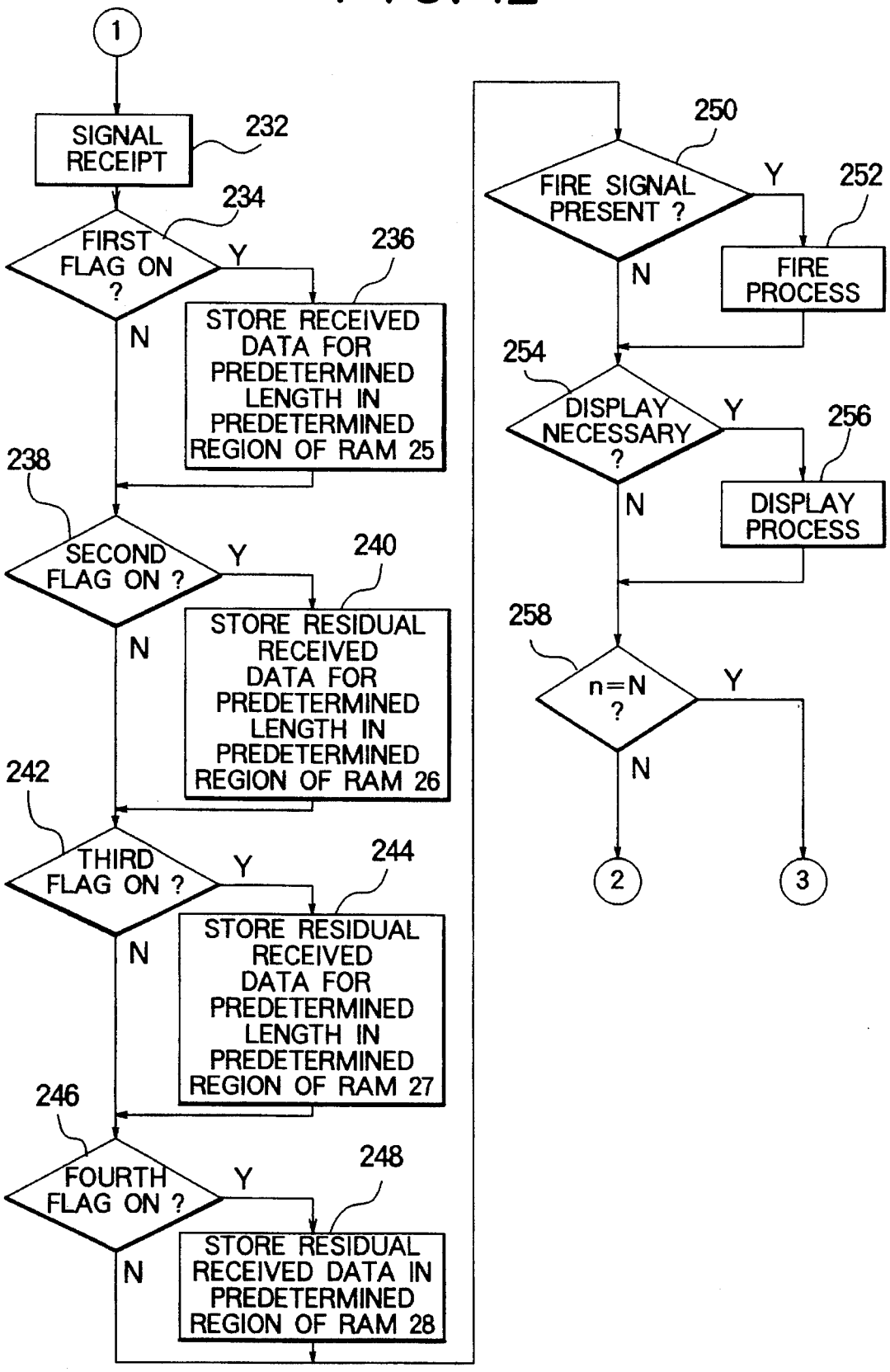

FIG. 11 of FIGS. 11 and 12, which illustrate the operation of the fire receiver 11, illustrates the process to be performed until the fire receiver 11 transmits a command signal to the n-th main transmitter. The left portion of FIG. 12 illustrates a process for storing received data contained in a signal received from the called n-th main transmitter in predetermined regions of predetermined RAMs, that is, random access memories (storage region RAM 25 to RAM 28) depending upon the type of the received data. The right portion of FIG. 12 illustrates a process for determining information denoting the occurrence of fire (for example, the fire signal or the physical quantity signal of a fire phenomenon with which a fire occurring must be determined) or information to be displayed (for example, the operation of the devices to be controlled, the test results, the disconnection of the signal line extending from the main transmitter to the terminal devices, to which the transmitters 31 to 33 and the analog fire detectors 34 are connected) from the received data (the state information stored in the storage region RAM 25 and the test results stored in the storage region RAM 26) in the signal received from the called n-th main transmitter to perform a fire process and a display process.

Referring to FIG. 11, if state information of the n-th main transmitter must be required in step 208 when the fire receiver 11 transmits a command signal to the n-th main transmitter, the fire receiver 11, in step 210, first turns on a first flag B21 of the typed-data storage region RAM 23, the first flag B21 indicating that the information is the state information, and stores a state information return command into the transmission data storage region RAM 24. If the n-th main transmitter or the devices relating to the main transmitter must be tested in step 212, a second flag of the typed-data storage region RAM 23 indicating the information relates to the test information is turned on. Further, the test contents (for example, the operation test of the main transmitter, the operation tests of the devices to be controlled and the operation tests of the child transmitters) to be performed are stored in the transmission data storage region RAM 24.

If a determination has been made in step 216 that the test result performed by the n-th main transmitter is required, the second flag of the typed-data storage region RAM 23 indicating that the information is relates to the test information is turned on in step 218. Further, the test result return command is stored into the transmission data storage region RAM 24. If a determination has been made in step 220 that the devices to be controlled, such as the smoke block/exhaust devices, and the state of ringing of the local bell relating to the n-th main transmitter must be controlled, a third flag of the typed-data storage region RAM 23 indicating that the information relates to the control information is turned on in step 222. Further, a control command (for example, a local bell ringing command/ringing stoppage command, a command to close the fire door, a command to open the smoke exhaust door, a command to start/stop the operation of the smoke exhaust fan) is stored in the transmission data storage region RAM 24.

If a determination has been made in step 224 that DB (data base) information having an arbitrary data length must be obtained from the n-th main transmitter, a fourth flag of the typed-data storage region RAM 23 indicating that the information relates to the DB information is turned on in step 226. Further, a command (if a plurality of DBs are used, a return command indicating the required DB among the plural DBs or a return command indicating that all of DBs are required) to return the required DB information is stored in the transmission data storage region RAM 24.

Then, in step 228, the data length of one or a plurality of command DATA stored in the storage region RAM 24 is calculated, and the flag of the storage region RAM 22 corresponding to the data length is turned on. In step 230, the self-address TAD, the receiver address RAD (that is, the address of the n-th main transmitter) and the CRC code and the like are added to the data length DL in the storage region RAM 22, the data type indication DI in the RAM 23 and the data DATA in the RAM 24 so that the format shown in FIG. 9 is made and the format is transmitted.

Figure 13:
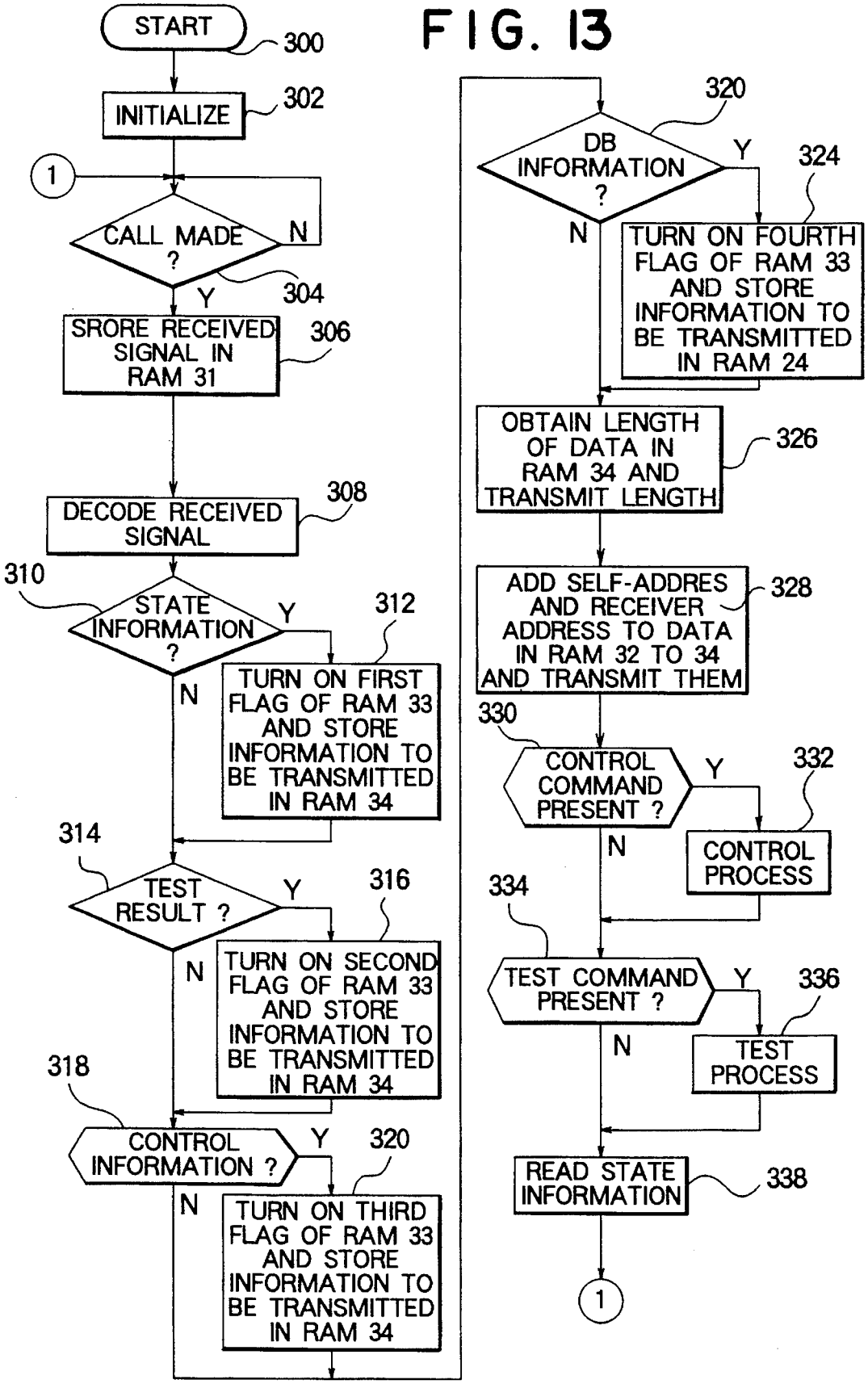
FIG. 13 is a flowchart for explaining the operation of the main transmitter according to the second embodiment.

Referring to the flowchart of the operation of the main transmitter shown in FIG. 13, when the n-th transmitter is called from the fire receiver 11 in step 304, the main transmitter temporarily stores the received signal into the operation region RAM 31 in step 306, and an examination by making use of the CRC code is performed. Then, the main transmitter decodes the data length signal DL, the data identification signal DI and the data signal DATA of the received signal in step 308.

Then, if the main transmitter has determined in step 310 that B21 of the data identification signal DI in the received signal supplied from the fire receiver 11 is "1" and that the contents of the data signal DATA indicate the state information return command, the flow proceeds to step 312 in which state information read out from a terminal device in step 338 and stored in the storage region RAM 35 is stored in the leading 2 bytes of the storage region RAM 34 for storing data to be transmitted, and in which the first flag B21 of the storage region RAM 33 is turned on, that is, set to a "1".

If a determination has been made in step 314 that B22 of the data identification signal DI in the received signal is a "1" and that the content of the data signal DATA is the test result return command, the flow proceeds to step 316 in which test result information, stored, as the result of a test process to be described later in step 336, in the storage region RAM 21, is stored in the 2 bytes of the storage region RAM 34 following the state information if the state information has already been stored. If the state information is not stored, the test result information is stored in the leading 2 bytes of the storage region RAM 34. Further, B22 of the storage region RAM 33 is set to a "1".

If a determination has been made in step 318 that B23 of the data type identification signal DI included in the received signal is a "1" and that the content of the data signal DATA is the control information requirement command, the flow proceeds to step 320. If the storage region RAM 31 has stored the control information (control commands for controlling the other main transmitters, for example, the local alarm sounding stoppage cancellation command relating to the other main transmitters and an on/off command for turning on/off the smoke venting devices and the like) for controlling the fire receiver 11 and other main transmitters, the foregoing control information is stored in the 2 bytes of the storage region RAM 34 in a case where the state information or the test result information has already been stored, the 2 bytes being disposed following the state information and the test result information. If the foregoing information items have not been stored, the control information is stored in the leading 2 bytes of the storage region RAM 34. Further, B23 of the storage region RAM 33 is set to "1".

If a determination has been made in step 322 that B24 of the data identification signal DI in the received signal is a "1" and the content of the data signal DATA is the DB information return command, the flow proceeds to step 324 in which all data or required data is read out from the storage region ROM 33. If the state information or the test result information or the control information has already been stored, data read out from the storage region ROM 33 is stored in the ensuing even bytes of the storage region RAM 34. If the foregoing information has not been stored, the data is stored in the leading even bytes of the storage region RAM 34. Further, B24 of the storage region RAM 33 is set to a "1".

In step 326, the data length of the foregoing information stored in the storage region RAM 34 in steps 312, 316, 320 or 324 is then calculated, and the flag of the storage region RAM 32 corresponding to the data length is turned on. In step 328, SSY, TAD, RAD, CRC and ESY are added to each data signal stored in the storage region RAM 32 to RAM 34 and they are transmitted.

If a determination has been made in step 330 as a result of decoding of the data signal DATA received from the fire receiver 11 performed in step 308 that the control command issued to the n-th main transmitter is included in the data signal DATA, the control command is decoded and a corresponding control process is performed in step 332. If a determination has been made in step 334 that the test command is present, the flow proceeds to step 336 in which the test command is decoded and the corresponding test process is performed. If necessary, test result information is stored in the RAM 31. Then, state information collected, by polling, from the terminal device connected to the main transmitter is read in step 338 and the state information is stored in the storage region RAM 35.

In the operation of the fire receiver 11 shown in FIG. 12, when a signal is received from the called n-th main transmitter in step 232, whether or not the received signal is correct is determined by the CRC or the sum check.

If a determination has been made in step 234 that the first flag (B21) of DI in the received signal has been turned on, data for the leading predetermined length, that is, the 2 bytes, is, as the state information, stored in a predetermined region allocated to the n-th main transmitter of the storage region RAM 25 in step 236.

If a determination has been made in step 238 that the second flag (B22) has been turned on, data for the ensuing 2 bytes included in the DATA is, as the test result information, stored in a predetermined region allocated to the n-th main transmitter of the storage region RAM 26 in step 240.

If a determination has been made in step 242 that the third flag (B23) has been turned on, data for the another ensuing 2 bytes contained in the DATA is, as the control information (for example, control information for controlling the other main transmitter), stored in a predetermined region allocated to the n-th main transmitter of the storage region RAM 27 in step 244.

Finally, if a determination has been made in step 246 that the fourth flag (B24) has been turned on, the flow proceeds to step 248 in which all of the residual data included in DATA is, as DB information (for example, for 8 bytes), stored in a predetermined region allocated to the n-th main transmitter of the storage region RAM 28.

If a determination has been made in step 250 that the state information received from the called main transmitter and stored in the storage region RAM 25 includes a fire signal or a physical quantity signal denoting a fire phenomenon with which the fire occurence must be determined or a gas leakage signal, the fire process is performed in step 252 in which the main bell in the fire receiver is rung, the fire region is displayed in accordance with DB, that is, the data base stored in the storage region RAM 28, and a preparation for transmitting a local bell ringing command and a command to operate the smoke venting devices to the relative main transmitters, that is, the control command, is performed (the commands are transmitted at the time of next polling the main transmitter). If a determination has been made in step 254 that the test result information or the state information includes information to be displayed, such as the control result of the smoke venting devices (opening, closing and the like) and a defect (a failure or a disconnection) of the main transmitter, the transmitter, the analog fire detector or the single line or the like, the foregoing display process is performed in step 256.

Although the foregoing embodiment is arranged so that the plural kinds of data signals DATA are transmitted, only the data base may be transmitted at the time of transmitting the data base without transmitting the other data. In the case where only the data base is transmitted as described above, the transmission signal may include the data length signal DL and the data signal DATA composed of only the data base while omitting the data type identification signal DI.

According to the foregoing second embodiment, the fire alarm system arranged such that the fire receiver polls the terminals, such as the transmitters to which the supervisory terminals and the devices to be controlled are connected and the analog fire detectors to transmit and receive a data signal between the fire receiver and the terminal is constituted in such a manner that the fire receiver and the terminals, that transmit data, calculates the data length signal denoting the length of the data signal to be transmitted and also transmits the data length signal when the data signal is transmitted. The portion for receiving the signal group thus-transmitted is able to receive the signal group while determining the data signal, the length of which has been indicated by the data length signal. Therefore, the length of the data signal can be varied in accordance with the quantity of information to be transmitted. As a result, an effect can be obtained in that the time taken to complete the transmission can be adjusted, and therefore, waste in transmission can be prevented.

When the data signal including at least a single kind data is transmitted, the signal group including the data length signal denoting the length of the data signal to be transmitted, the data type signal for indicating the type of the data for each data included in the data signal to be transmitted, and the data signal in which the various data items are arranged in the sequential order instructed with the data type signal are transmitted. The portion for receiving the signal group thus-transmitted sequentially determines the contents of the data items of the types included in the data signal in accordance with the contents instructed by the data length signal and the data type signal. Therefore, the length of the data signal can be varied in accordance with the quantity of the information to be transmitted. Further, the data signal including the data of only the types that are required to be transmitted/received can be transmitted. Therefore, a similar effect can be obtained in that the time taken to complete the transmission can be adjusted., and therefore, waste in transmission can be prevented.

What is claimed is:

1. A fire alarm system having a fire receiver to which a plurality of terminal devices are connected and arranged so that said fire receiver polls each of said terminal devices to transmit and receive a data signal, said fire alarm system being characterized in that:

each of said fire receiver and said plural terminal devices comprises:

a self-address memory, said self-address memory storing a self-address added for the purpose of mutual identification;

a receiver address memory, said receiver address memory storing the addresses of other terminal devices and said fire receiver, which are the receivers of said signal;

a signal transmitter, said signal transmitter transmitting said data signal in such a manner that said self-address stored in said self-address memory and said addresses of said receiver stored in said receiver address memory are added to said data signal; and a comparator, said comparator comparing an address signal of said receiver included in said signal received and said self-address stored in said self-address memory and performing a discrimination process for processing said received data signal if said two addresses coincide with each other;

wherein said terminal devices are transmitters to which detectors and devices to be controlled are connected;

and wherein each of said transmitters of said terminal devices includes:

an information-receiver address memory, said information receiver address memory storing the addresses of other transmitters that must be linkage-controlled if fire has been detected in accordance with a signal supplied from said detector connected to said transmitter;

an indicator, said indicator giving information to said fire receiver by said signal transmitter if fire has been detected in accordance with said signal supplied from said detector connected to said transmitter and for giving information to said other transmitters stored in said information-receiver address memory;

a linkage-control memory storing information regarding devices that must be linkage-controlled among said devices connected to said transmitter if fire has been detected in accordance with said signal supplied from a detector connected to one of said transmitter and the other transmitters; and a controller, said controller controlling corresponding devices in accordance with the content of said linkage-control memory if fire has been detected in accordance with said signal supplied from said detector connected to said transmitter or if information has been given from said indicator of the other transmitter.

2. A fire alarm system having a fire receiver to which a plurality of terminal devices are connected and arranged so that said fire receiver polls each of said terminal devices to transmit and receive a data signal, said fire alarm system being characterized in that:

each of said fire receiver and said plural terminal devices comprises:

a self-address memory, said self-address memory storing a self-address added for the purpose of mutual identification;

a receiver address memory, said receiver address memory storing the addresses of other terminal devices and said fire receiver, which are the receivers of said signal;

a data length calculator, said data length calculator calculating the length of said data signal to be transmitted to form data length signal;

a signal group transmitter, said signal group transmitter transmitting a signal group formed by adding said self-address stored in said self-address memory, said address of said receivers stored in said receiver address memory and said data length signal formed by said data length calculator to said data signal; and a decoder, said decoder comparing an address signal of said receiver included in a received signal and said self-address stored in said self-address memory, decoding the content of each signal in said received signal group if said receiver address signal and said self-address coincide with each other, and determining the length of said data signal in accordance with said data length signal included in said signal group;

wherein said terminal devices are transmitters to which detectors and devices to be controlled are connected;

wherein each of said transmitters of said terminal devices includes:

an information-receiver address memory, said information-receiver address memory storing the addresses of other transmitters that must be linkage-controlled if fire has been detected in accordance with a signal supplied from said detector connected to said transmitter;

an indicator, said indicator giving information to said fire receiver by said signal group transmitter if fire has been detected in accordance with said signal supplied from said detector connected to said transmitter and for giving information to said other transmitters stored in said information-receiver address memory;

a linkage-control memory, said linkage-controlled memory storing information regarding devices that must be linkage-controlled among said devices connected to said transmitter if fire has been detected in accordance with said signal supplied from said transmitter or a detector connected to one of said transmitter and the other transmitters; and a controller, said controller controlling corresponding devices in accordance with the content of said linkage-control storage region if fire has been detected in accordance with said signal supplied from said detector connected to said transmitter or if information has been given from said indicator of the other transmitter.

* * * * *